US009613602B2

(12) United States Patent
Welch et al.

(10) Patent No.: US 9,613,602 B2
(45) Date of Patent: Apr. 4, 2017

(54) TUNABLE VIBRATING MEMBRANE TENSIONING SYSTEM

(71) Applicants: Samuel Justin Welch, Englewood, CO (US); Patrick B. Auell, Morrison, CO (US); John C. Montana, Englewood, CO (US); Adam N. Auell, Morrison, CO (US)

(72) Inventors: Samuel Justin Welch, Englewood, CO (US); Patrick B. Auell, Morrison, CO (US); John C. Montana, Englewood, CO (US); Adam N. Auell, Morrison, CO (US)

( * ) Notice: Subject to any disclaimer, the term of this patent is extended or adjusted under 35 U.S.C. 154(b) by 0 days.

(21) Appl. No.: 14/821,784

(22) Filed: Aug. 9, 2015

(65) Prior Publication Data

US 2017/0040005 A1 Feb. 9, 2017

(51) Int. Cl.
*G10D 13/02* (2006.01)

(52) U.S. Cl.
CPC ..... *G10D 13/023* (2013.01)

(58) Field of Classification Search
CPC ..... G10D 13/023; G10D 1/10
See application file for complete search history.

(56) References Cited

U.S. PATENT DOCUMENTS

| | | | | | |
|---|---|---|---|---|---|
| 19,602 | A * | 3/1858 | Zimmerman | G10D 13/023 | 84/413 |
| 223,586 | A * | 1/1880 | Fayaux | G10D 13/023 | 24/457 |
| D27,155 | S * | 6/1897 | Noble | D17/22 | |
| 795,034 | A * | 7/1905 | Harris | G10D 13/023 | 84/413 |
| 889,762 | A * | 6/1908 | Converse | G10D 13/023 | 84/411 R |
| 1,335,867 | A * | 4/1920 | Walton | G10D 13/023 | 84/413 |
| D340,206 | S * | 10/1993 | Bonney | D11/130.1 | |
| 8,153,876 | B2 * | 4/2012 | Krishnamurthy | G10D 13/023 | 84/411 A |
| 8,642,867 | B1 * | 2/2014 | Bedson | G10D 13/023 | 84/413 |
| 9,006,548 | B2 * | 4/2015 | Bedson | G10D 13/023 | 84/413 |
| 9,349,355 | B2 * | 5/2016 | Jones | G10D 13/023 | |
| 2006/0272478 | A1 * | 12/2006 | Steinhour | B29C 44/12 | 84/452 P |
| 2015/0107440 | A1 * | 4/2015 | Bedson | G10D 13/023 | 84/413 |
| 2016/0240175 | A1 * | 8/2016 | Bedson | G10D 13/023 | |

* cited by examiner

*Primary Examiner* — Robert W Horn

(57) ABSTRACT

A cable and pulley operated membrane tuning system suitable for drums and other musical instruments, as well as other applications requiring tunable membranes. The cable is threaded through pulleys or guides attached the mounting assembly of the membrane, and tightened by means of a tensioning mechanism. The system tensions membrane by varying the tension on the cable. The system may be employed in single-membrane systems or in multiple membrane systems.

19 Claims, 20 Drawing Sheets

TUNABLE VIBRATING MEMBRANE TENSIONING SYSTEM

BACKGROUND

Regardless of the type of drum, the heads must be properly tensioned (or tuned) prior to playing. Traditional head tensioning systems involve a system of threaded lugs and brackets. The brackets, with interior female threading, are bolted into the exterior of the shell of the drum. The lugs, with exterior male threading, are inserted through holes in a tensioning hoop that is secured over the rim of the drumhead. The lugs are then individually screwed into the brackets on the shell. When the drum is tuned, each lug is individually tightened, and the drumhead tuned overall by means of tapping on the head near each lug individually and gradually bringing the entire head up to the desired tension and its associated tone. Since tightening of any lug affects overall tension, this process must be repeated a number of times to bring the head to final tension. If the drum has a head on each end, this entire process is repeated for both heads. This approach has several downsides: attachment of the brackets to the drum shell requires penetrating the shell with a large number of holes, which may adversely affect sound, and which adds significantly to the cost of manufacture. More importantly, the drum cannot readily be tuned during performance, since the tap-and-tighten approach to tuning is time-consuming and requires a reasonably quiet environment, which may well not be the case in a music venue. In the case of the bottom head, it would also require removing the drum from its stand and flipping it over to repeat the process; all of which is impractical during a time-constrained performance, and annoying otherwise.

Prior attempts to develop a quick tuning method for drums are impractical for several reasons: they involve very complex mechanisms with a great many moving parts which are sensitive to mis-adjustment, and therefore inadequately robust for the needs of performing percussionists; they require drums that are purpose-built to take the specific tuning mechanism in question, and are therefore useless to the percussionist using a standard drum kit; and they are applicable only to single headed drums, and are therefore again relatively useless to a drummer using a standard trap set, which normally incorporates only double-headed drums.

The present invention avoids all of these downsides. Rather than using a complex system of hardware parts and cabling which can only be applied to the purpose-built drum, this invention tensions both heads on the drum simultaneously using a single run of cable which is threaded through pulleys (or in a less expensive variation, guides or grommets) in a laced pattern between the 2 heads. A tensioning mechanism or similar device is used to adjust the tension on the cable, which is then transmitted to all attachment points for the pulleys on both heads simultaneously. This permits rapid re-tuning of a drum during a performance. The utility is enhanced by including a tension gauge in the cable-tensioner assembly, which facilitates accurate tuning so a specific desired pitch by bringing the cable to a pre-determined tension. Since drumhead pitch is a function of cable and head tension, the system allows accurate re-tuning even as the cable and head age and stretch, and even in noisy venues where re-tuning by listening to pitch may be impracticable or where atmospheric variations make frequent re-tuning necessary.

The only hardware items needed for this invention are modified tensioning hoops, or attachments to standard hoops, to accommodate the pulleys or cable guides, and the cable-tensioner assembly itself. This means that in addition to being used on new drums, it can be retrofitted to an existing drum shell with little or no modification of the shell itself.

The present invention is readily distinguishable from prior drumhead tensioning systems in general. Unlike a lug-and-bracket system, the current invention may or may not use brackets and uses no lugs at all. This also eliminates the need for a drum key or any other hand tool to tune the drum. The entire set of hardware associated with those and similar systems is avoided entirely, with only a single potential attachment point of the system to the drum shell, that of the tensioning mechanism. See U.S. Pat. No. 674,550 (screws and lugs), U.S. Pat. No. 973,661 (clips), U.S. Pat. No. 1,722,032 (hoops and turnbuckles), U.S. Pat. No. 8,912,416 (lugs), U.S. Pat. No. 7,138,574 (bolts), U.S. Pat. No. 5,561,255 (lugs).

It is also readily distinguishable from prior cable-based systems, which involve multiple cables and associated complex tensioning systems, and which require specialized, purpose-specific drums for their utilization. In U.S. Pat. No. 7,488,882, the system involves multiple cables attached to a complex sliding ring assembly that rotates around the circumference of the drum shell. The cables are attached individually to the tensioning hoop on one end and the ring assembly on the other, passing over stop posts between the ends. As the ring rotates the cables are stretched around the stop posts, increasing tension on the cables. This system requires multiple cables around the circumference of the drumhead, each individually attached to the rotating ring. Since overall tension of the drumhead is a function of the combined tensions of all cables, the system is very sensitive to the individual cables tensions, and thereby to any cable stretching or other misalignment of those tensions. And, the entire system is designed for use in a single, purpose-specific drum which is itself part of the patent.

In U.S. Pat. No. 4,244,265 the system is again based upon multiple cables, but instead of the peg and rotating ring assembly of the above patent, it relies upon a tensioning lever at the bottom of the drum. Because it also uses multiple cables, the system is susceptible to all of the defects and weaknesses cited above, and is again designed to be used on a single, purpose-specific drum, which is itself part of the patent.

In both cases, the system is limited to single headed drums and cannot be adapted to double-headed drums. Nor can either system be used on a standard drum shell such as that from a trap set snare drum or tom-tom.

DETAIL DESCRIPTION

DISCUSSION OF DRAWINGS AS THEY RELATE TO THE INVENTION

Figure 1:
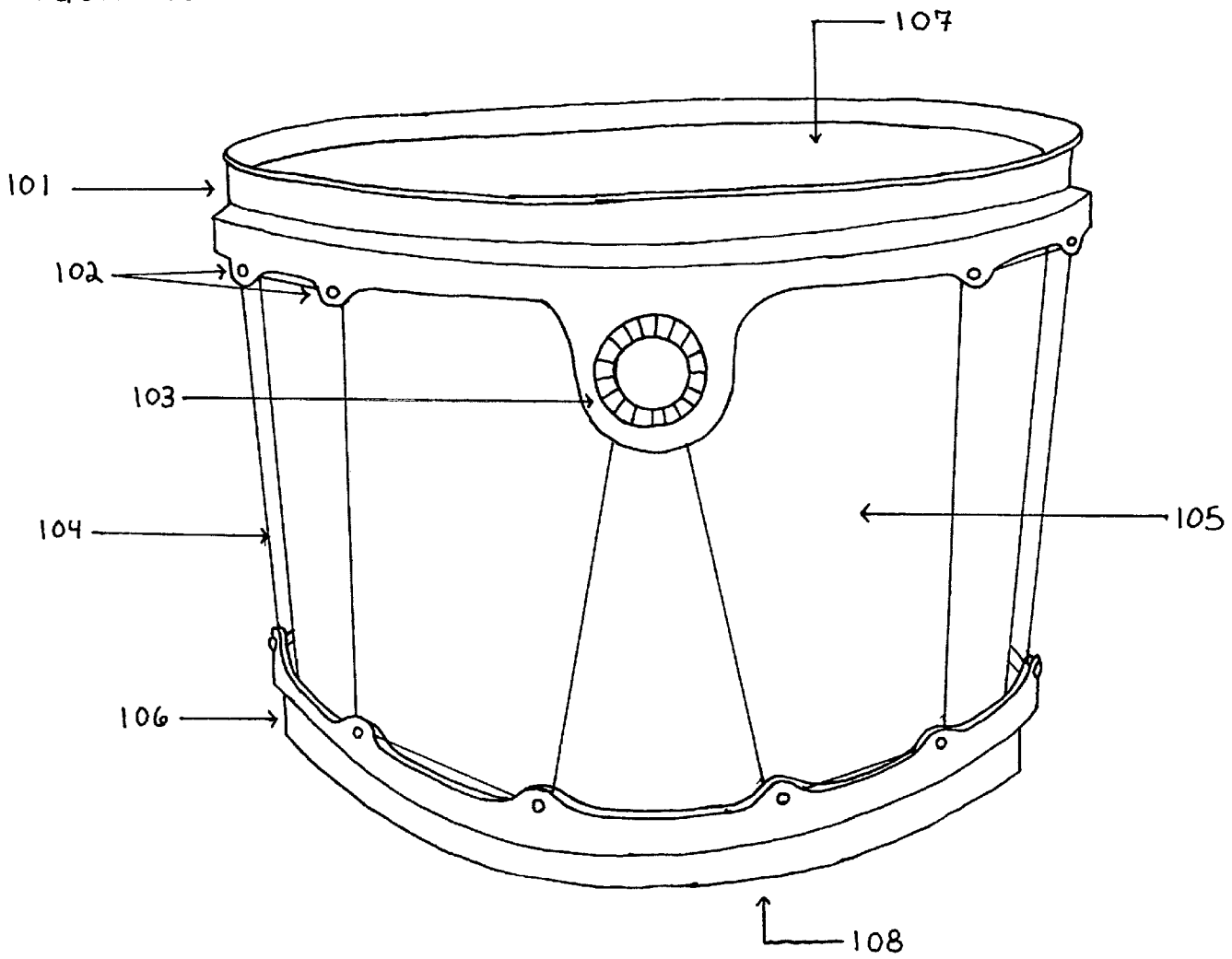
FIG. 1 illustrates the overall layout of the basic variation of the invention on a standard trap set snare or tom-tom drum.

In FIG. 1, the basic concept of the invention is illustrated.

101 is the top hoop of the drum, which acts as a retainer band for the drum head itself, and is the part to which downward force must be applied, both to retain the head on the drum and to tune it.

102 are the pulleys or guides around which the cable is threaded.

103 is the cable tensioning mechanism

104 is the cable itself.

105 is the drum shell

106 is the bottom hoop and pulleys or guides, which acts in exactly the same manner as A, the top hoop.

107 is the top, or batter head.

108 is the bottom, or resonant head.

Figure 2:
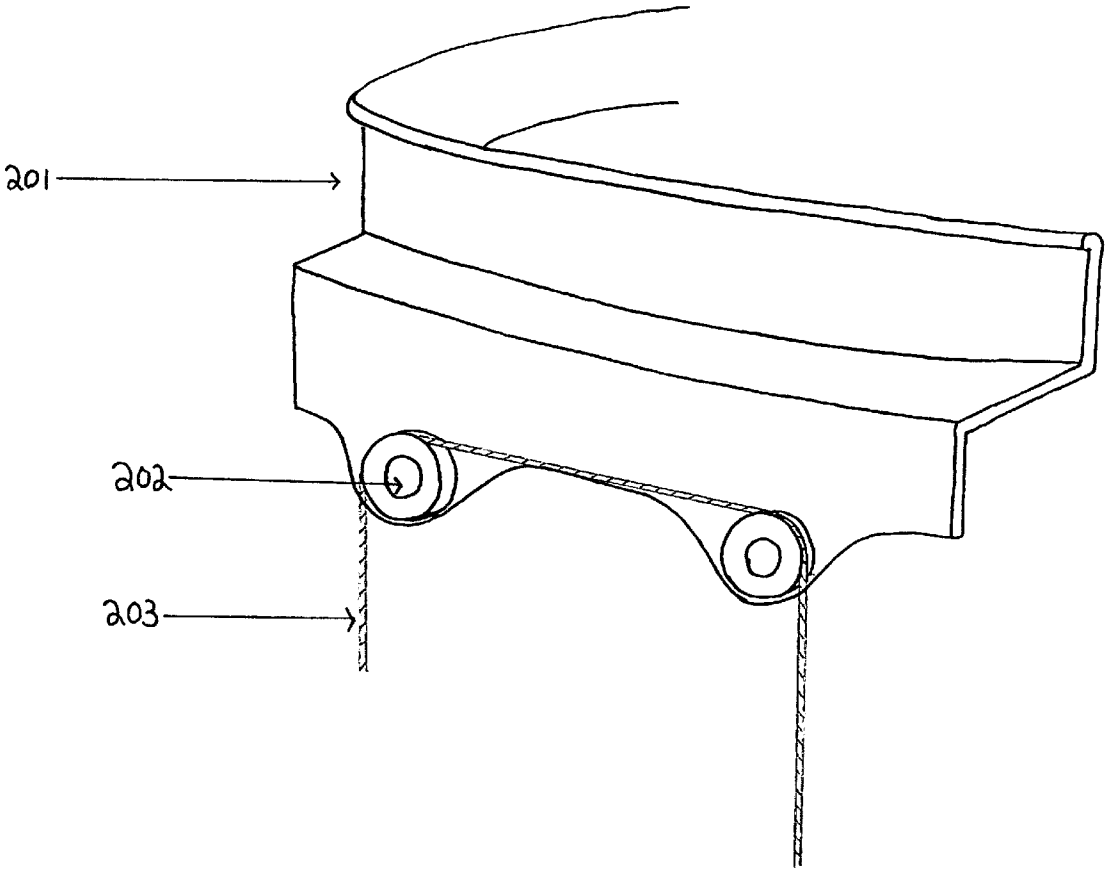
FIG. 2 shows detail of the pulley or guide assembly on the top hoop.

FIG. 2 demonstrates the cable and pulley arrangement.

201 is the top hoop.

202 is the pulley or guide.

203 is the cable.

The drum is tuned by turning the cable tensioning mechanism (103), which winds the cable (104) on a spindle or post, increasing or decreasing its tension depending upon the direction in which the tensioning mechanism is turned. The change in tension is distributed over the entire length of the cable, and via the pulley or guide system (102 and 106), to both hoop/drum head assemblies (101/107 and 106/108) simultaneously. Thus, a single tensioning mechanism and cable controls the tension of all points along the rim of both heads, and thereby the pitches of both heads. Both heads are thus tuned in their entirety with a single adjustment. Since pitch is a function of head tension, the heads can be accurately tuned even in a noisy venue by simply turning the tensioning mechanism until a desired pre-determined tension is reached.

Figure 3:
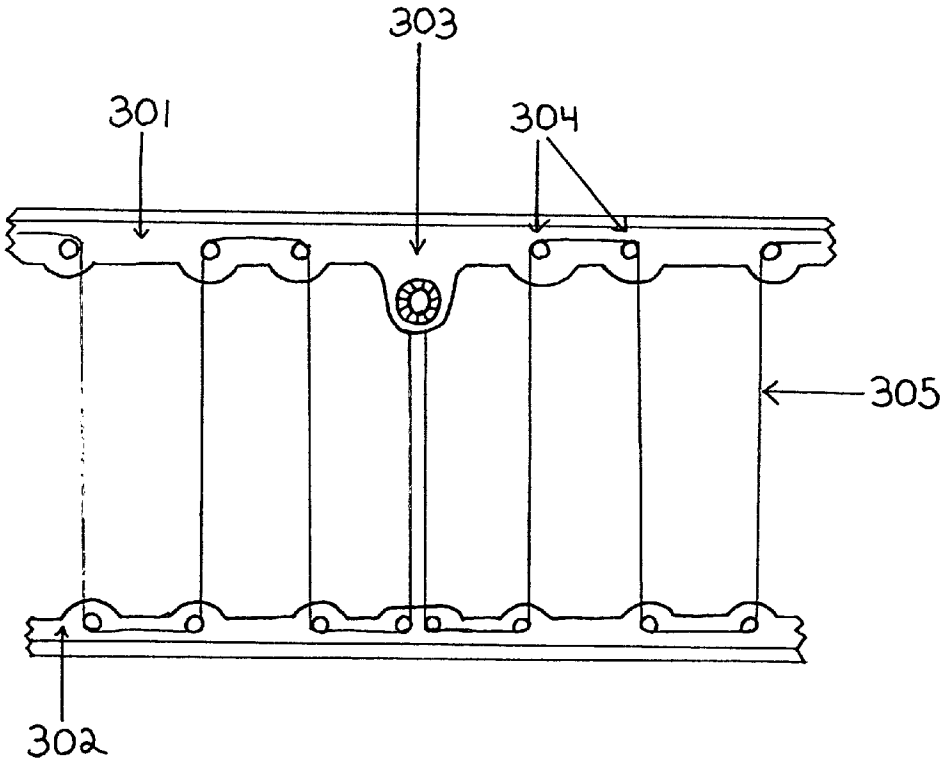
FIG. 3 shows the invention in side view.

FIG. 3 shows a potential cable arrangement.

301 is the top hoop.

302 is the bottom hoop.

303 is the cable tensioning mechanism.

304 are the pulleys or guides.

305 is the cable.

Figure 4:
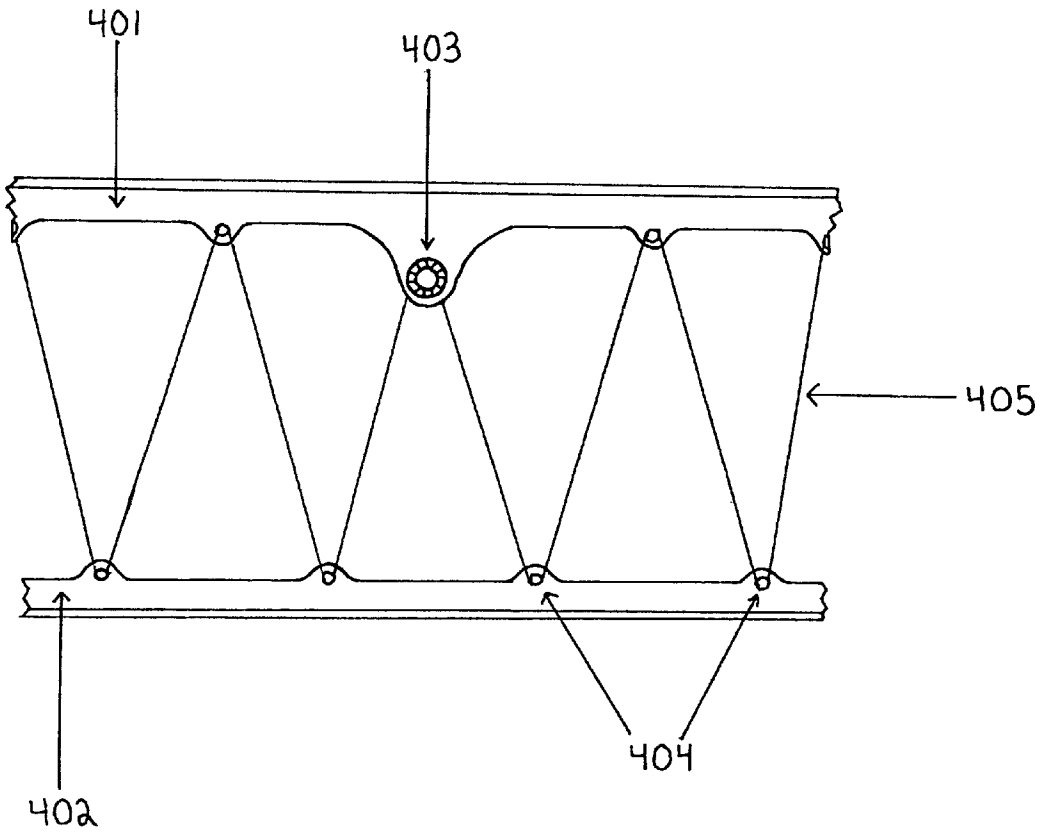
FIG. 4 shows an alternative cable winding pattern.

Note that the system works with alternative cable winding patterns. FIG. 4 shows an alternative cable arrangement.

401 is the top hoop.

402 is the bottom hoop.

403 is the cable tensioning mechanism.

404 are the pulleys or guides.

405 is the cable.

FIGS. 5, 6, 7, 8, 9, 10, 11 and 12 illustrate several variations of pulley or guide mechanisms mounted to a top hoop. Assemblies for bottom hoops would be identical, merely reversed in orientation.

Figure 10:
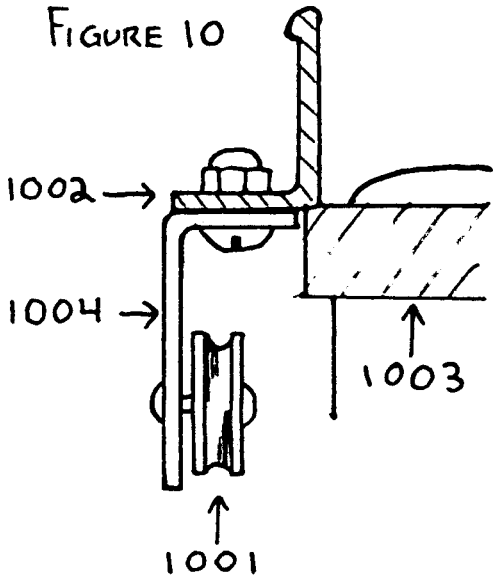
FIG. 10 shows a removable pulley or guide assembly.
Figure 11:
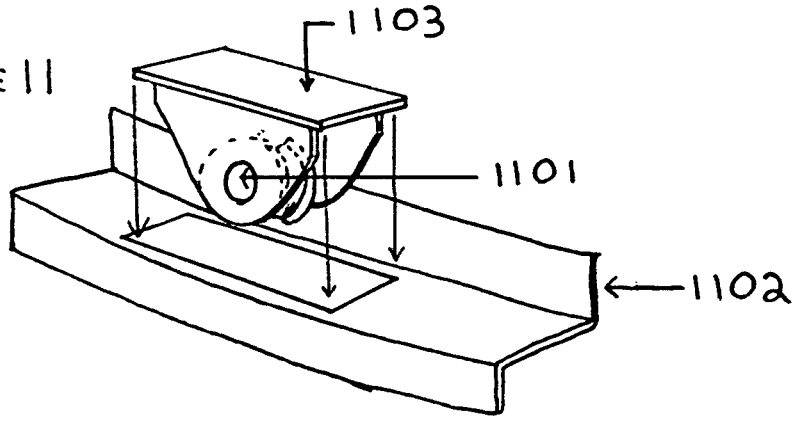
FIG. 11 shows another potential removable pulley or guide assembly removed.
Figure 12:
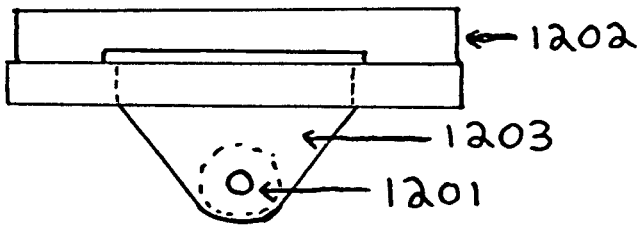
FIG. 12 shows a removable pulley or guide assembly in place.
Figure 13:
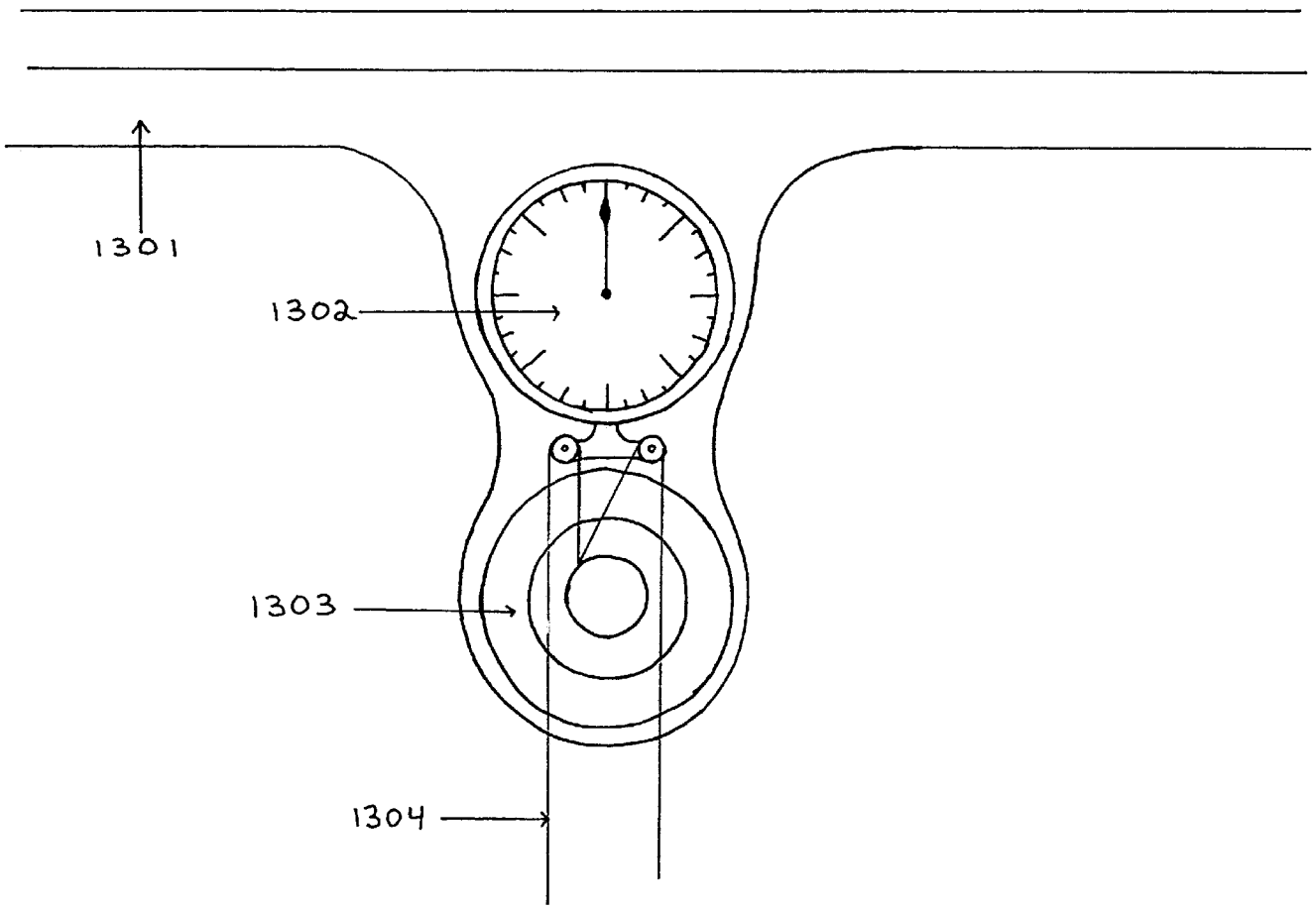
FIG. 13 shows one example of an integrated tension/force/displacement measuring device.

In FIGS. 5, 6, 7, 8 and 9 the pulley or guide assemblies are manufactured as an integral part of a custom drum hoop by forming or attaching an extended flange on the hoop into a geometry which would accommodate pulleys or guides and their associated axles and retainer hardware. In FIGS. 10, 11 and 12, each pulley is part of a independent pulley assembly. Each pulley assembly is separate and removable, either bolted through standard drum hoop holes or dropped through a slot in a custom hoop and retained by the base on one end and the cable on the other, thus permitting ready replacement of a worn or defective pulley by de-tensioning the cable and removing the defective pulley.

Figure 5:
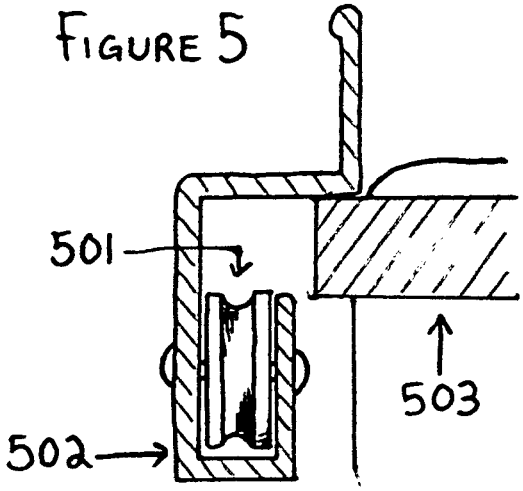
FIG. 5 shows a side view of a potential pulley or guide assembly.

In FIG. 5:

501 is the pulley or guide

502 is the hoop

503 is the drum head

Figure 6:
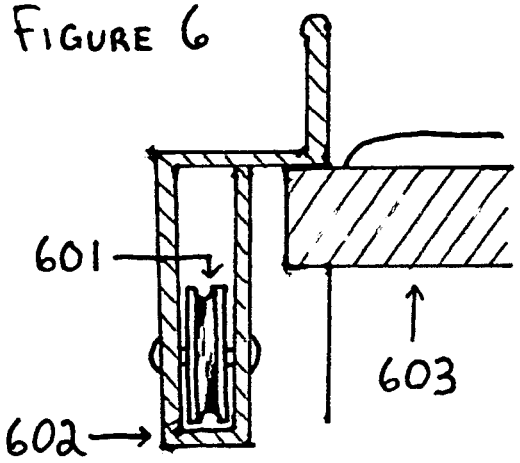
FIG. 6 shows a side view another potential pulley or guide assembly.

In FIG. 6:

601 is the pulley or guide

602 is the hoop

603 is the drum head

Figure 7:
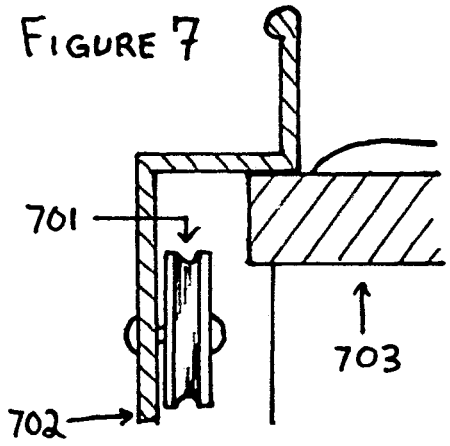
FIG. 7 shows a side view another potential pulley or guide assembly.

In FIG. 7:

701 is the pulley or guide

702 is the hoop

703 is the drum head

Figure 8:
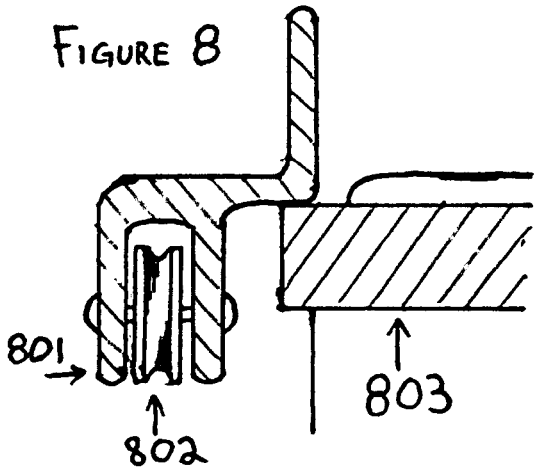
FIG. 8 shows a side view another potential pulley or guide assembly.

In FIG. 8:

801 is the hoop

802 is the pulley or guide

803 is the drum head

Figure 9:
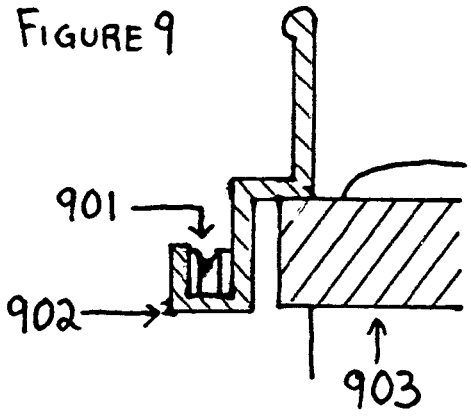
FIG. 9 shows a side view another potential pulley or guide assembly.

In FIG. 9:

901 is the pulley or guide

902 is the hoop

903 is the drum head

In FIG. 10:

1001 is the pulley or guide

1002 is the hoop

1003 is the drum head

1004 is the independent pulley or guide assembly

In FIG. 11:

1101 is the pulley or guide

1102 is the hoop

1103 is the independent pulley or guide assembly

In FIG. 12:
1201 is the pulley
1202 is the hoop
1203 is the independent pulley or guide assembly
Figure shows a strain gauge.
1301 is the hoop.
1302 is the strain gauge.
1303 is the tensioning mechanism.
1304 is the cable.

Variations on the Basic System of the Invention

The basic system is highly adaptable to the specific need of an individual percussionist and to the desired capabilities of the particular drum in question. Below are several variations that are likely to be of interest to working percussionists.

Single Head Drums and Independently Tunable Heads

Figure 14:
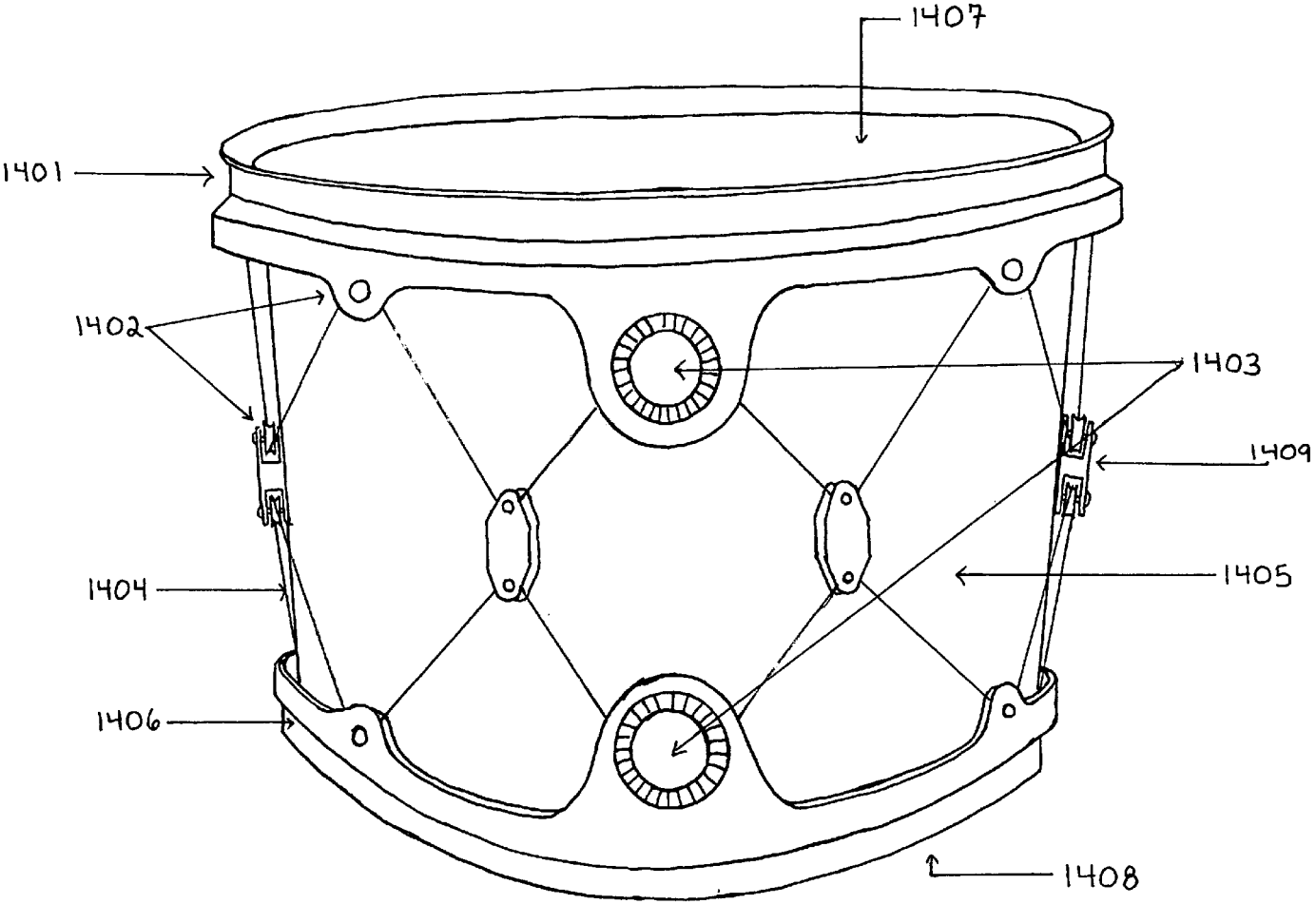
FIG. 14 shows an independently tunable top and bottom head, utilizing hardware mounted on the drum shell. In this case, the cable for each head is run over an additional guide set on the drum shell rather than passing to the opposite head.
Figure 15:
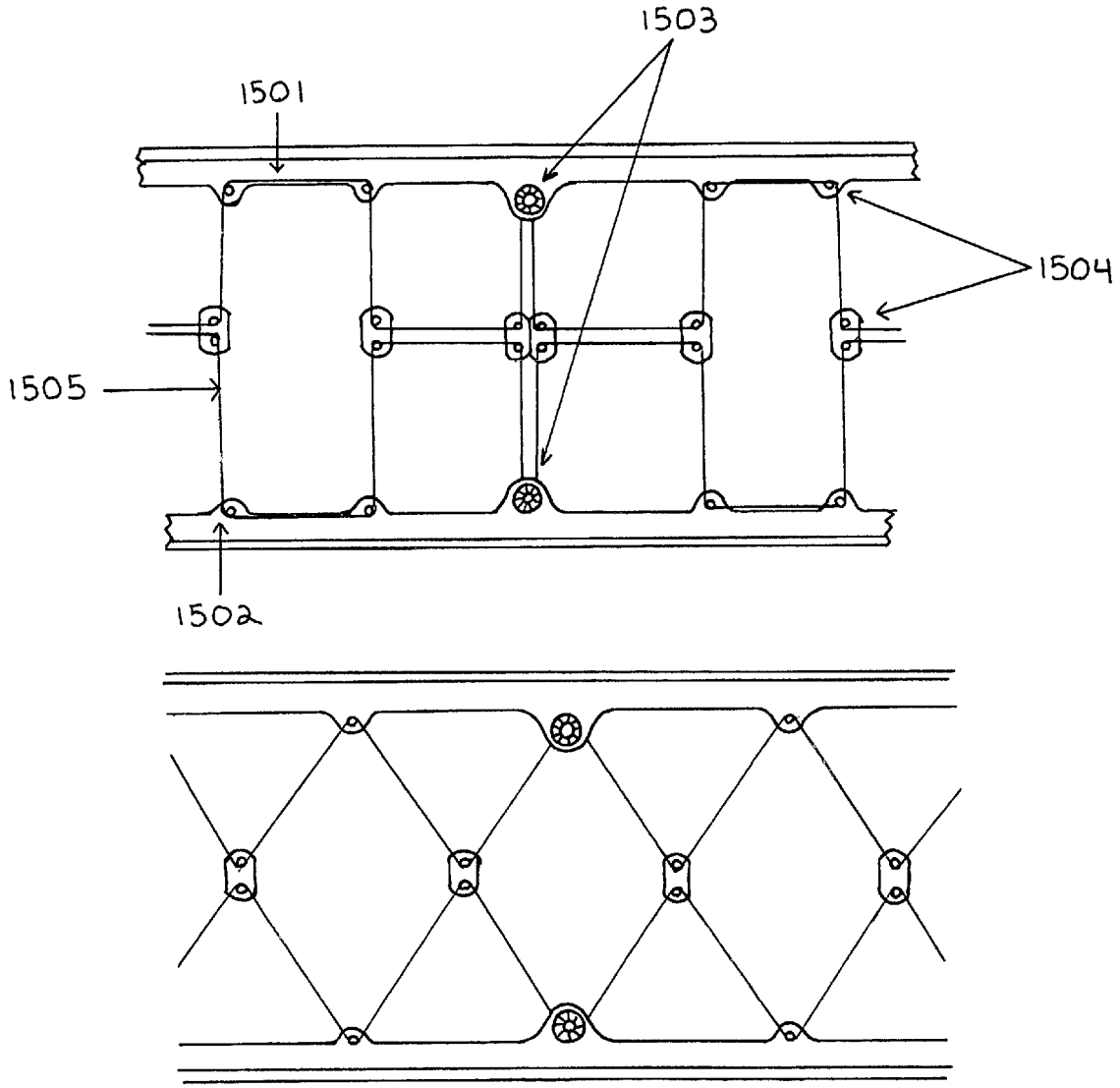
FIG. 15 shows alternative cable routing for independently tunable heads.
Figure 16:
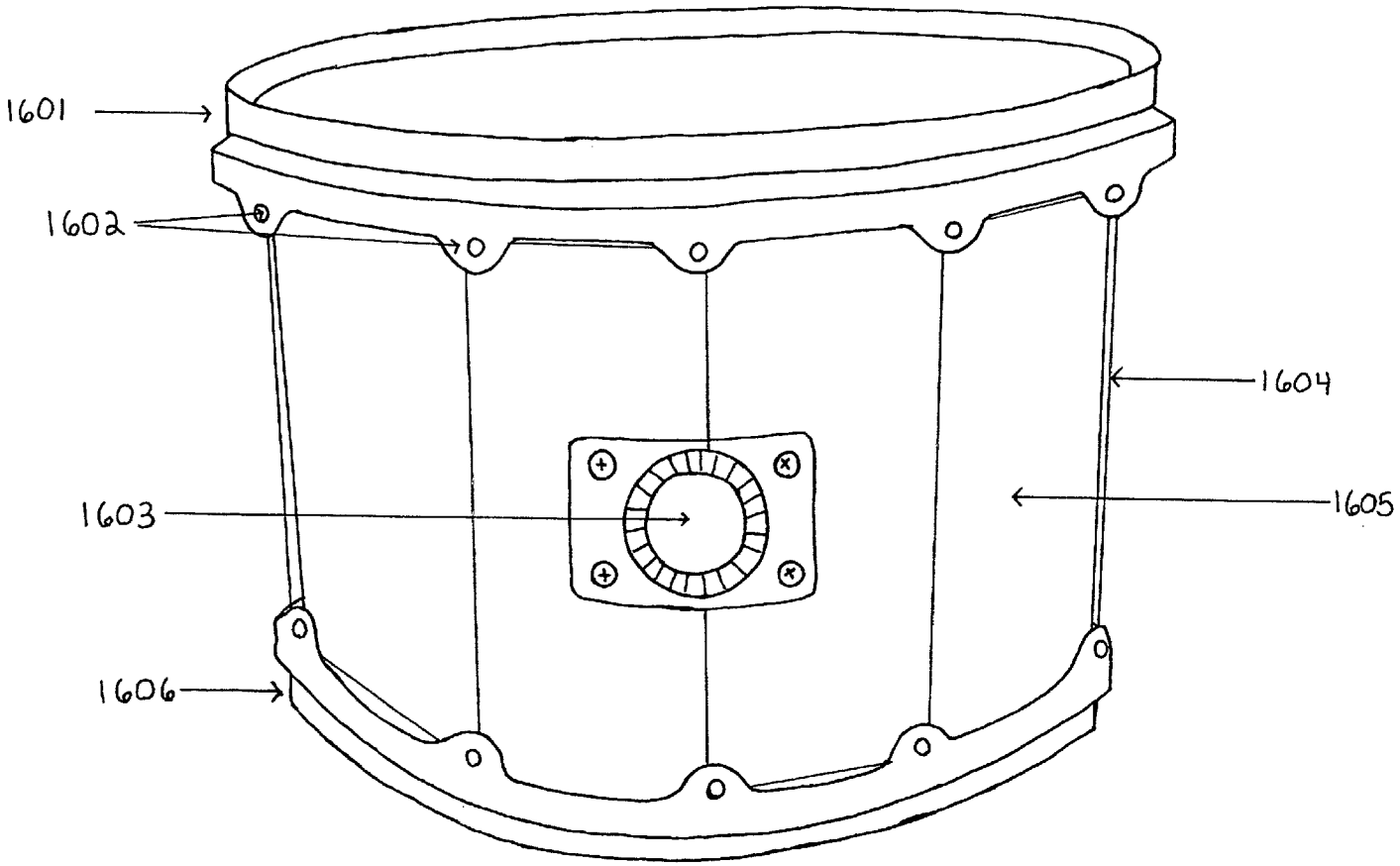
FIG. 16 shows the cable tensioning mechanism attached to the drum shell instead of the hoop.
Figure 17:
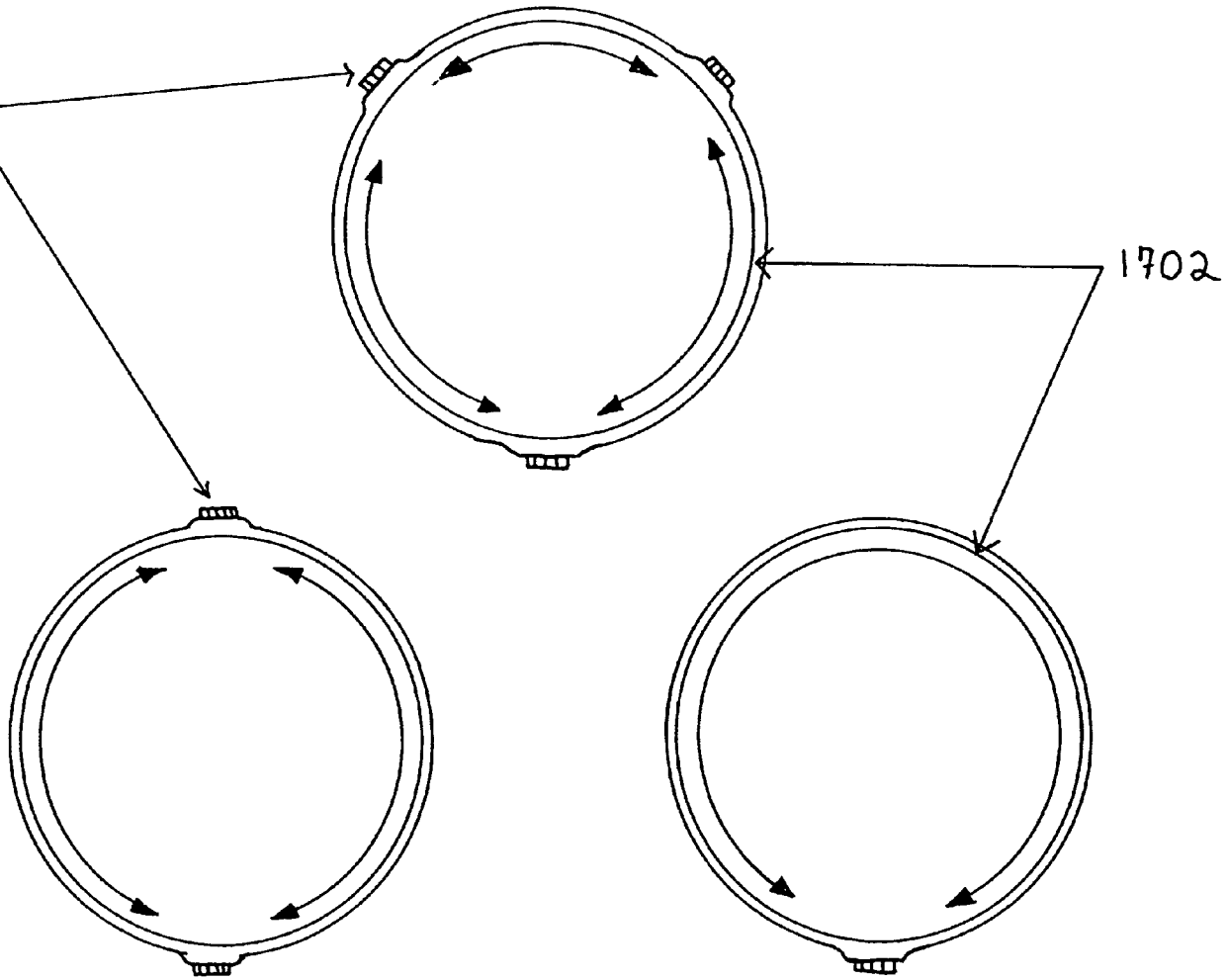
FIG. 17 shows options for more than one tensioning mechanism to increase accuracy and even tension around the drum.
Figure 18:
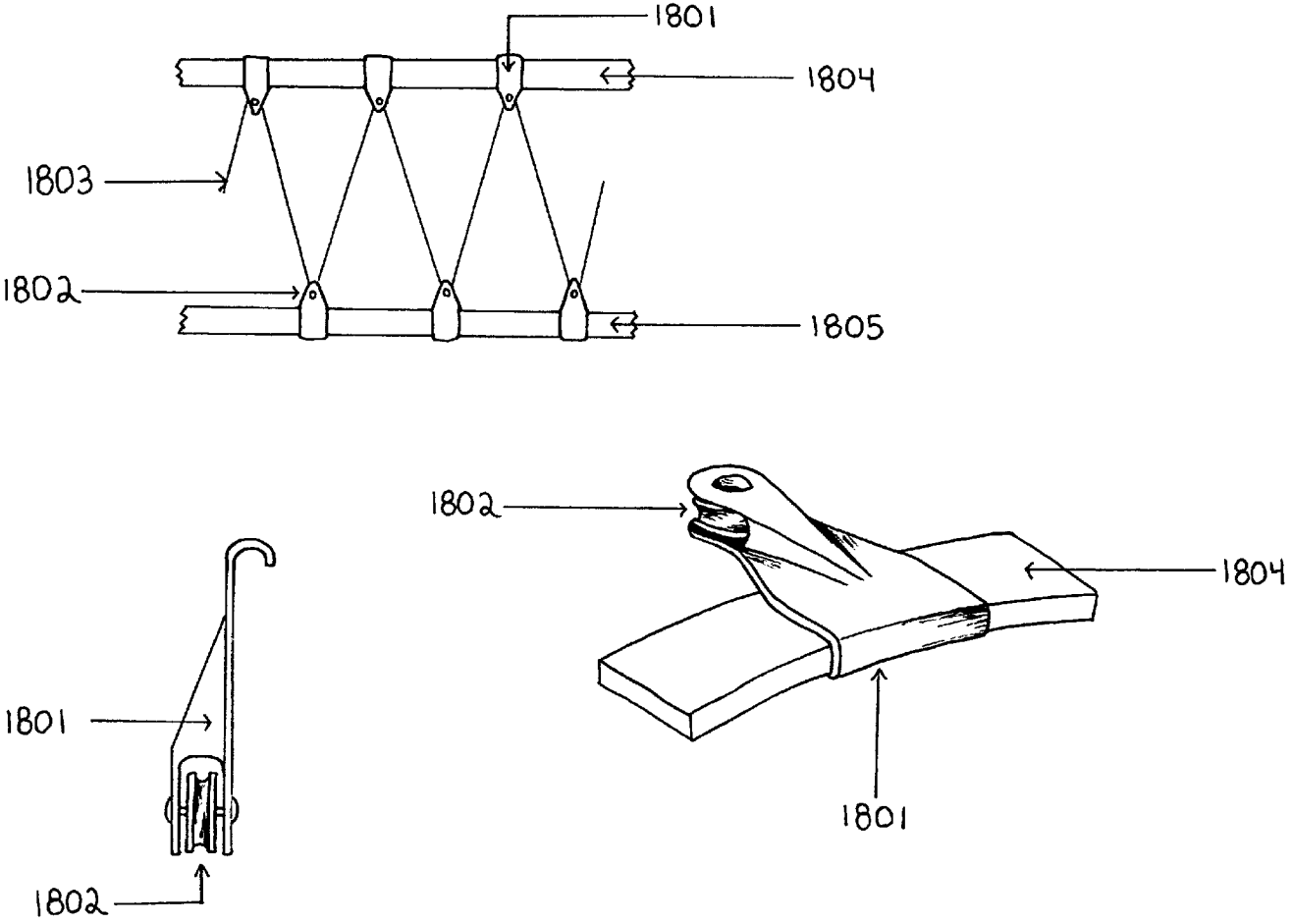
FIG. 18 shows the system applied to a drum with wooden hoops (which cannot be altered to receive the pulley assemblies described above) by means of removable pulleys attached to the hoop by hooking over the rim. Note that this is also an alternative arrangement for applying the invention to an existing drum with a metal hoop in cases where replacement of the hoop is not desired.
Figure 19:
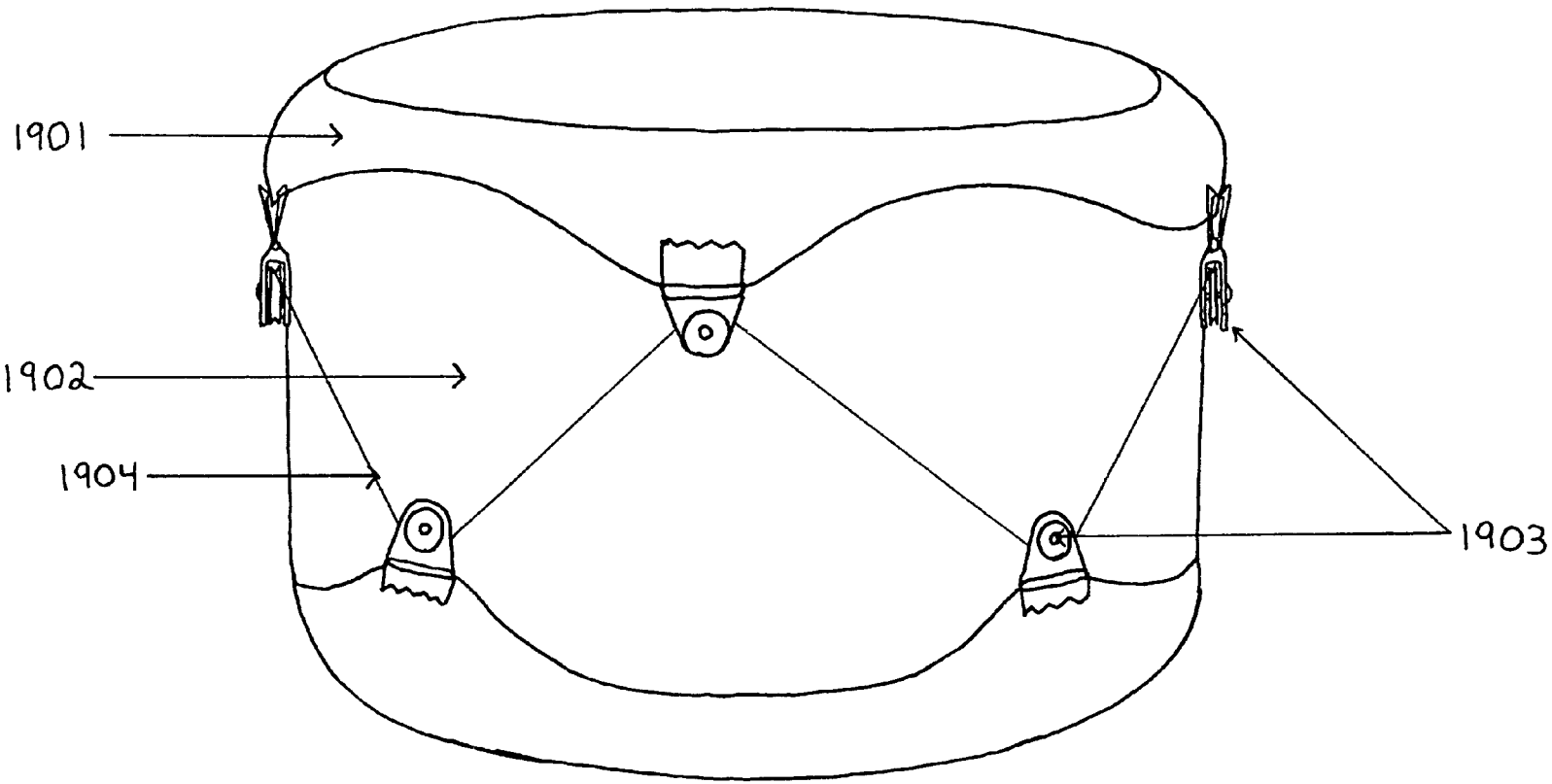
FIG. 19 shows the system applied to a drum that requires no hoops, in which case the pulley/guides are attached directly to the skin/head.

The system is adaptable to single-headed drums by mounting the lower pulleys or guides to the drum shell rather than to a hoop, or by utilizing two single-head systems to double-headed drums that the percussionist wishes to tune separately. FIG. 14 shows an overall view of the invention with independently tunable heads. 1401 is the top hoop of the drum, which acts as a retainer band for the drum head itself, and is the part to which downward force must be applied, both to retain the head on the drum and to tune it.
1402 are the pulleys or guides around which the cable is threaded.
1403 is the cable tensioning mechanism
1404 is the cable itself.
1405 is the drum shell
1406 is the bottom hoop and pulleys or guides, which acts in exactly the same manner as A, the top hoop.
1407 is the top, or batter head.
1408 is the bottom, or resonant head.
1409 is the pulley or guide hardware attached to the drum shell.
FIG. 15 shows alternative cable routing.
1501 is the top drum hoop.
1502 is the bottom drum hoop.
1503 is the tensioning mechanism(s)
1504 is the pulley or guide.
1505 is the cable.
FIG. 16 shows the tensioning mechanism mounted to the drum shell.
1601 is the top drum hoop.
1602 is the pulley or guide
1603 is the tensioning mechanism mounted to the drum shell.
1604 is the cable.
1605 is the drum shell.
1606 is the bottom drum hoop.
FIG. 17 shows tensioning mechanism arrangements.
1701 is the tensioning mechanism.
1702 is the drum hoop.
FIG. 18 shows the system applied to wooden drum hoops.
1801 is the metal bracket/hook
1802 is the pulley or guide
1803 is the cable
1804 is the drum hoop
1805 is the drum hoop
FIG. 19 shows an integration in which there are no hoops.
1901 is the skin/head
1902 is the drum shell
1903 is the independent pulley/guide assembly
1904 is the cable

Integration with Other Vibrating Membrane Instruments

Figure 20:
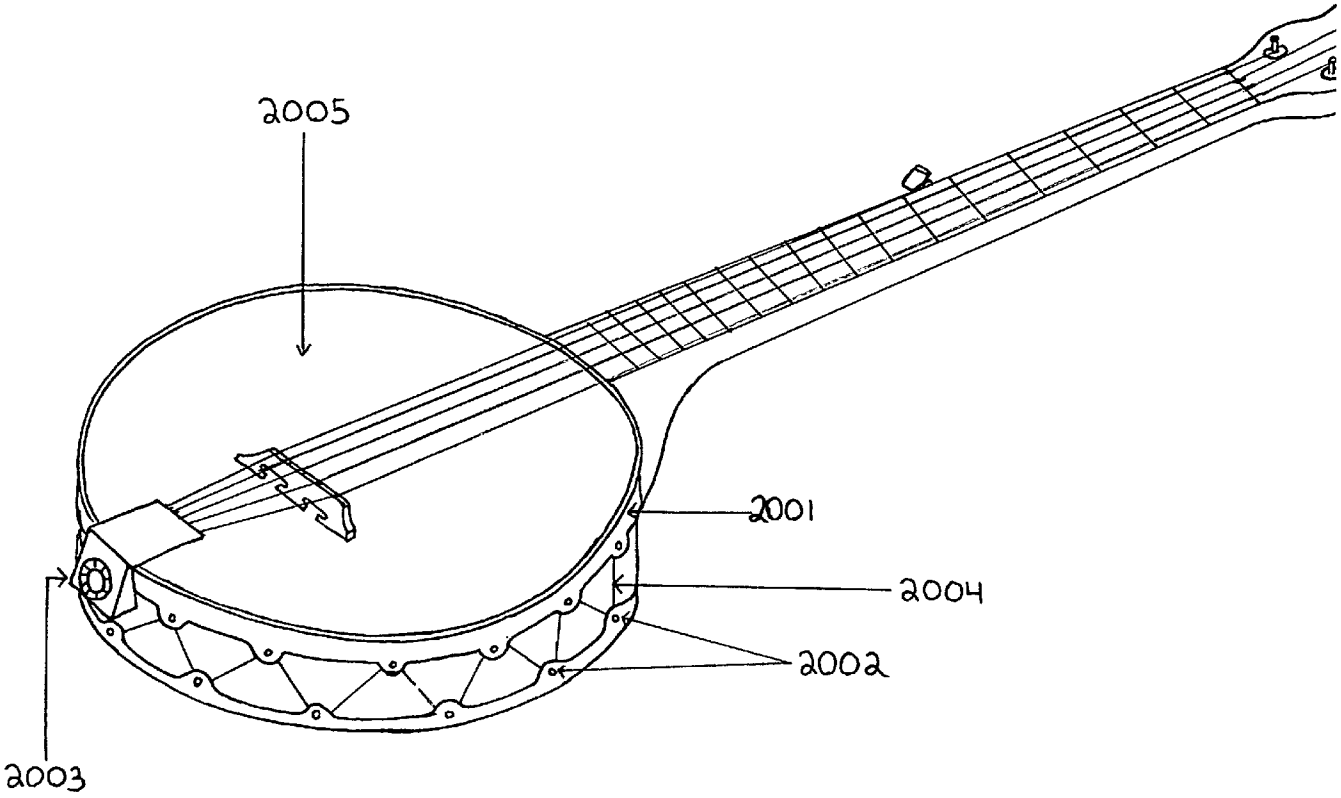
FIG. 20 shows the cable/pulley system as applied to the banjo.

This system can also be applied to other instruments that incorporate a head/skin/vibrating membrane, such as the banjo, sitar, tambourine, etc. FIG. 20 shows a banjo with the cable/pulley system.
2001 is the banjo head hoop
2002 is the pulley/guide
2003 is the tensioning mechanism
2004 is the cable
2005 is the banjo head

Other Applications

The invention can also be applied in other environments and applications which employ a vibrating membrane that require tuning or tension adjustment.

The invention claimed is:

1. A tensioning system for simultaneously tuning and securing top and bottom stretchable vibrating membranes to a cylindrical shell, comprising:
- a top hoop with a cylindrical rim parallel to the cylindrical shell, facing inwardly of the top membrane and having a clearance space between said rim and cylindrical shell;
- a bottom hoop with cylindrical rim parallel to the cylindrical shell, facing inwardly of the bottom membrane and having a clearance space between said rim and cylindrical shell;
- a cable that runs between said top hoop and bottom hoop within the respective clearance spaces of the top and bottom cylindrical rims;
- tensioning means for tightening said cable;
- wherein said tensioning means is mounted on the cylindrical shell so that when said tensioning means is tightened, said top hoop and bottom hoop are simultaneously pulled toward each other by said cable thereby simultaneously stretching the top and bottom membranes.

2. A tensioning system for simultaneously tuning and securing top and bottom stretchable vibrating membranes to a cylindrical shell, comprising:
- a top hoop with a cylindrical rim parallel to the cylindrical shell, facing inwardly of the top membrane and having a clearance space between said rim and cylindrical shell;
- a bottom hoop with cylindrical rim parallel to the cylindrical shell, facing inwardly of the bottom membrane and having a clearance space between said rim and cylindrical shell;
- a cable that runs between said top hoop and bottom hoop within the respective clearance spaces of the top and bottom cylindrical rims;
- tensioning means for tightening said cable;
- wherein said tensioning means is mounted on the cylindrical rim of the top or bottom hoop so that when said tensioning means is tightened, said top hoop and bottom hoop are simultaneously pulled toward each other by said cable thereby simultaneously stretching the top and bottom membranes.

3. A tensioning system for simultaneously tuning and securing opposing vibrating membranes on each side of a cylindrical shell, comprising:

a plurality of pulley or guide assemblies with an extended claw geometry which hooks over the edge of annular hoops, spaced around said hoops, wherein the pulley or guide lies inside the line of pull beyond said hoop in the space between said hoops around the circumference of the cylindrical shell;

a cable that runs between said pulley housings in the space between said hoops;

tensioning means for tightening said cable;

wherein said tensioning means is the only necessary hardware mounted on the cylindrical shell, independent from the hoops, so that when said tensioning means is tightened, said hoops on each side of the cylindrical shell are simultaneously pulled toward each other by said cable thereby simultaneously stretching both membranes.

4. A tensioning system for simultaneously tuning and securing top and bottom stretchable vibrating membranes to a cylindrical shell, comprising:

pulley or guide assemblies attached, bolted or fixed onto protruding flanges of top and bottom hoops, a cable that is threaded between said top and bottom pulley assemblies, tensioning means for tightening said cable;

wherein said tensioning means is the only necessary hardware mounted on the cylindrical shell so that when said tensioning means is tightened, said top hoop and bottom hoop are simultaneously pulled toward each other by said cable thereby simultaneously stretching the top and bottom membranes.

5. A tensioning system for simultaneously tuning and securing top and bottom stretchable vibrating membranes to a cylindrical shell, comprising:

pulley or guide assemblies attached, bolted or fixed onto protruding flanges of top and bottom hoops, a cable that is threaded between said top and bottom pulley assemblies, tensioning means for tightening said cable;

wherein said tensioning means is mounted to top or bottom hoop and there is no necessary hardware mounted on the cylindrical shell so that when said tensioning means is tightened, said top hoop and bottom hoop are simultaneously pulled toward each other by said cable thereby simultaneously stretching the top and bottom membranes.

6. The apparatus in claims 1-2 wherein; pulleys or guides are incorporated into a hoop shaped and machined to accommodate pulleys or guides around its circumference by forming or attaching an extended flange or pulley housing assembly on the hoop into a geometry which would accommodate pulleys or guides and their associated axles and retainer hardware within the respective clearance spaces of the top and bottom cylindrical rims.

7. The apparatus in claims 1-2 wherein; pulley or guide assemblies are dropped into slots in said hoops within the respective clearance space between said rim and shell.

8. The apparatus in claims 1-4 wherein; a clock face type tension dial associated with cable tension, co-located with the tensioning means to measure and easily read the cable tension and therefor the membrane tension.

9. The apparatus in claims 1-4 wherein; a tension/force/displacement measuring device co-located with the tensioning means to measure and easily read the cable tension and therefor the membrane tension.

10. The apparatus in claims 1-2 wherein; a single tensioning means is used.

11. The apparatus in claims 1-2 wherein; multiple tensioning means are used.

12. The apparatus in claim 3 wherein; a single tensioning means is used.

13. The apparatus in claim 3 wherein; multiple tensioning means are used.

14. The apparatus in claim 4 wherein; a single tensioning means is used.

15. The apparatus in claim 4 wherein; multiple tensioning means are used.

16. A retrofit kit comprising the apparatus in claim 1.

17. A retrofit kit comprising the apparatus in claim 2.

18. A retrofit kit comprising the apparatus in claim 3.

19. A retrofit kit comprising the apparatus in claim 4.

* * * * *